United States Patent [19]

McClure

[11] Patent Number: 4,491,185

[45] Date of Patent: Jan. 1, 1985

[54] METHOD AND APPARATUS FOR PERFORATING SUBSURFACE EARTH FORMATIONS

[76] Inventor: Gerald B. McClure, 1830 Arcadia, Sugarland, Tex. 77478

[21] Appl. No.: 516,811

[22] Filed: Jul. 25, 1983

[51] Int. Cl.[3] ..... E21B 43/11

[52] U.S. Cl. ..... 175/4.56; 166/297; 102/204; 89/1.15

[58] Field of Search ..... 175/4.56, 4.54, 4.55, 175/4.6; 166/63, 297, 299, 55, 55.1; 102/204, 202.14, 202.5, 305, 306, 310; 89/1 C

[56] References Cited

U.S. PATENT DOCUMENTS

| | | | |
|---|---|---|---|
| 2,120,615 | 6/1938 | King | 175/4.55 |
| 2,155,322 | 4/1939 | McCullough | 175/4.56 |
| 2,419,371 | 4/1947 | Schlumberger | 175/4.56 |
| 2,873,675 | 2/1959 | Lebourg | 175/4.6 |
| 3,710,717 | 1/1973 | Tamplen | 102/204 |
| 3,800,705 | 4/1974 | Tamplen | 175/4.56 |

*Primary Examiner*—Stephen J. Novosad
*Assistant Examiner*—Thuy M. Bui

[57] ABSTRACT

Method and apparatus for completing subsurface formations traversed by a borehole. A perforating gun and a firing head assembly are run into the borehole on the end of a tubing string. A percussion firing assembly subsequently is lowered through the tubing string and latches into the firing head assembly. To initiate the firing system an impact member is dropped through the tubing string. Should ignition fail to occur the percussion firing assembly and a portion of the firing head assembly can be detached and removed from the borehole. An electrical firing assembly can be lowered through the tubing string into engagement with the remaining portion of the firing head assembly and an electrical control signal used to detonate the perforating gun. Should ignition again fail the electrical firing assembly is removed leaving a perforating system having no primary explosives therein, which can be removed from the borehole by pulling the tubing string.

20 Claims, 5 Drawing Figures

FIG.1
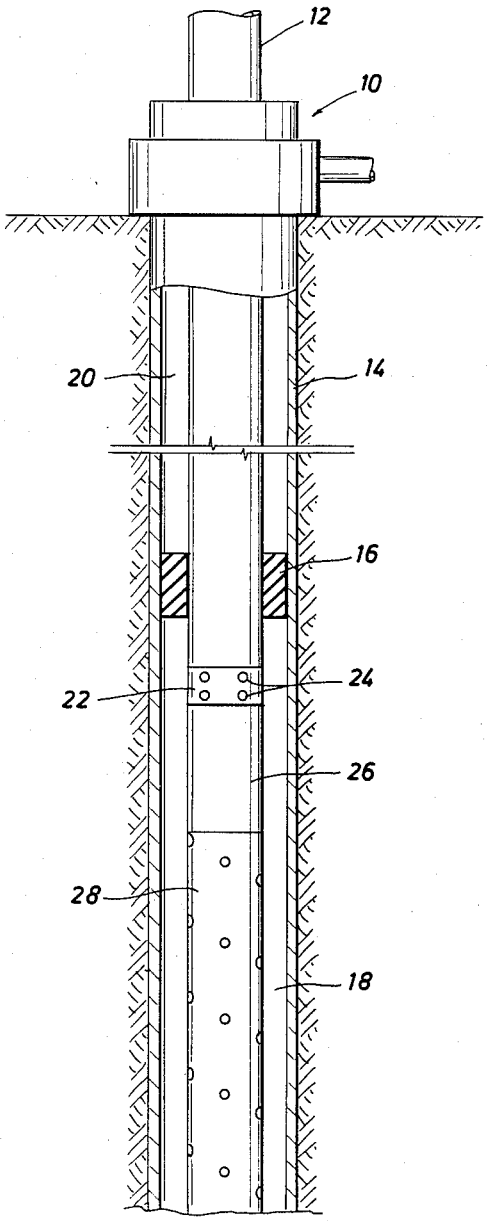
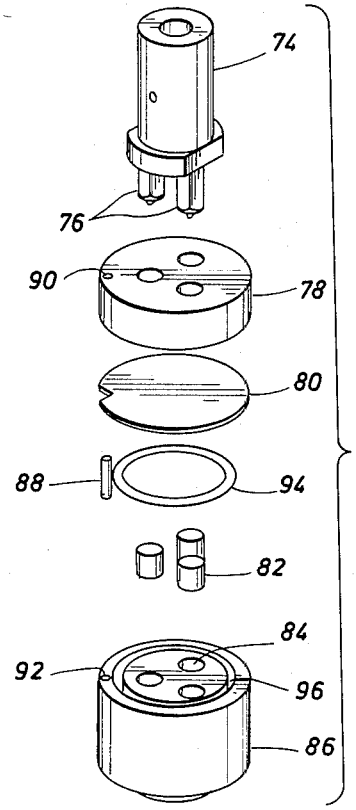
FIG. 3

METHOD AND APPARATUS FOR PERFORATING SUBSURFACE EARTH FORMATIONS

BACKGROUND OF THE INVENTION

This invention relates generally to subsurface well apparatus and more specifically, to methods and apparatus for perforating subsurface earth formations utilizing a tubing conveyed perforating apparatus.

It has become common practice in the completion of oil and gas wells to perforate the well casings and the surrounding formations to bring a well into production. One method of providing this capability has a perforating apparatus attached to the end of a tubing string which is lowered and set in place when the perforating apparatus is opposite the formation to be produced. The perforating apparatus may then be detonated and the well placed into production through the tubing strings.

The systems for firing the perforating apparatus have typically been either an electrical firing system or a non-electric percussion firing system. Neither method has been entirely satisfactory in the past since electrical firing systems require care in connection and running because these systems can be activated from stray electrical currents. In addition, electrical connections can be short-circuited by moisture. Percussion firing systems commonly have some primary explosives in the perforating apparatus while it is affixed to the tubing and lowered into position. As a result of the deficiencies of these firing systems, accidental and premature firings are a possibility. Further, in the event of a malfunction, making removal of a perforating apparatus necessary, the chance of accidental ignition of the perforating apparatus could prove dangerous to personnel.

These and other disadvantages are overcome with the present invention by providing a method and an apparatus for perforating well casing and the surrounding earth formations using a primary percussion firing system which is installed in the perforating assembly only after the perforating apparatus has been set and additionally by providing for removal of the percussion firing system in case of malfunction and installation of a secondary electrical firing system which likewise can be removed in case of malfunction.

SUMMARY OF THE INVENTION

In a preferred embodiment of the invention, a perforating system is provided which, in its overall concept, includes a perforating gun and a firing head assembly which are coupled to a tubing string and positioned thereby within a well adjacent a formation to be perforated. A percussion firing system includes a grapple end portion and an outwardly flared end portion for detachable coupling to a setting tool. The setting tool and the attached percussion firing system are lowered through the tubing string, into the firing head assembly where the grapple portion latches onto a first detonator stem. The setting tool and the wireline are removed leaving an armed firing system. To initiate the firing system an impact bar is dropped through the tubing string impacting a firing pin in the percussion firing system. The firing pin in turn impacts a plurality of explosive primer cartridges. The explosive force of the primer cartridges sets off a booster cartridge which sets up a detonating wave in a section of detonator cord which further detonates a shaped charge having an axis of perforation aligned substantially along the longitudinal axis of the firing head assembly. The jet from the shaped charge penetrates a loaded screw port mounted in the first detonator stem. The detonation of the loaded screw port is coupled by means of two booster charges and a length of detonator cord to a second shaped charge. The jet formed thereby detonates an explosively loaded screw port located in a second detonator stem. The detonation of the screw port is coupled by a booster charge, onto a length of detonator cord terminating at another booster charge in juxtaposition to a shaped charge. The jet from the shaped charge detonates a loaded screw port which transfers a detonation wave to a length of detonator cord which traverses the perforating gun thereby detonating the shaped charges therein to perforate the adjacent formations.

In the event ignition of the perforating gun is not caused by the impact bar hitting the firing pin an overshot grapple is lowered through the tubing string and engages an upper flared portion of the percussion firing system. Upward tension detaches the percussion firing system along with the first detonator stem which are removed from the well. An electrical firing head is lowered through the tubing string into the firing head assembly. A grapple end portion of the electrical firing head latches onto an end flared portion of the second detonator stem. An electrical signal detonates a shaped charge, the jet which detonates the loaded screw port in the second detonator stem thereby causing the detonation of the perforating gun in the above described manner. Should once again detonation not occur the electrical firing head is removed leaving a perforating system having no primary explosive therein. Now unarmed, the perforating gun and the firing head assembly can be removed from the well by pulling the tubing string.

These and other features and advantages of the present invention will be more readily understood by those skilled in the art from a reading of the following detailed description with reference to the accompanying drawings.

BRIEF DESCRIPTION OF THE DRAWINGS

FIG. 1 is a schematic elevational view of a perforating operation within a cased wellbore in accordance with the present invention.

FIG. 3 is a more detailed view of the percussion firing assembly of the firing head assembly of FIG. 2.

DETAILED DESCRIPTION OF THE PREFERRED EMBODIMENT

Figure 2A:
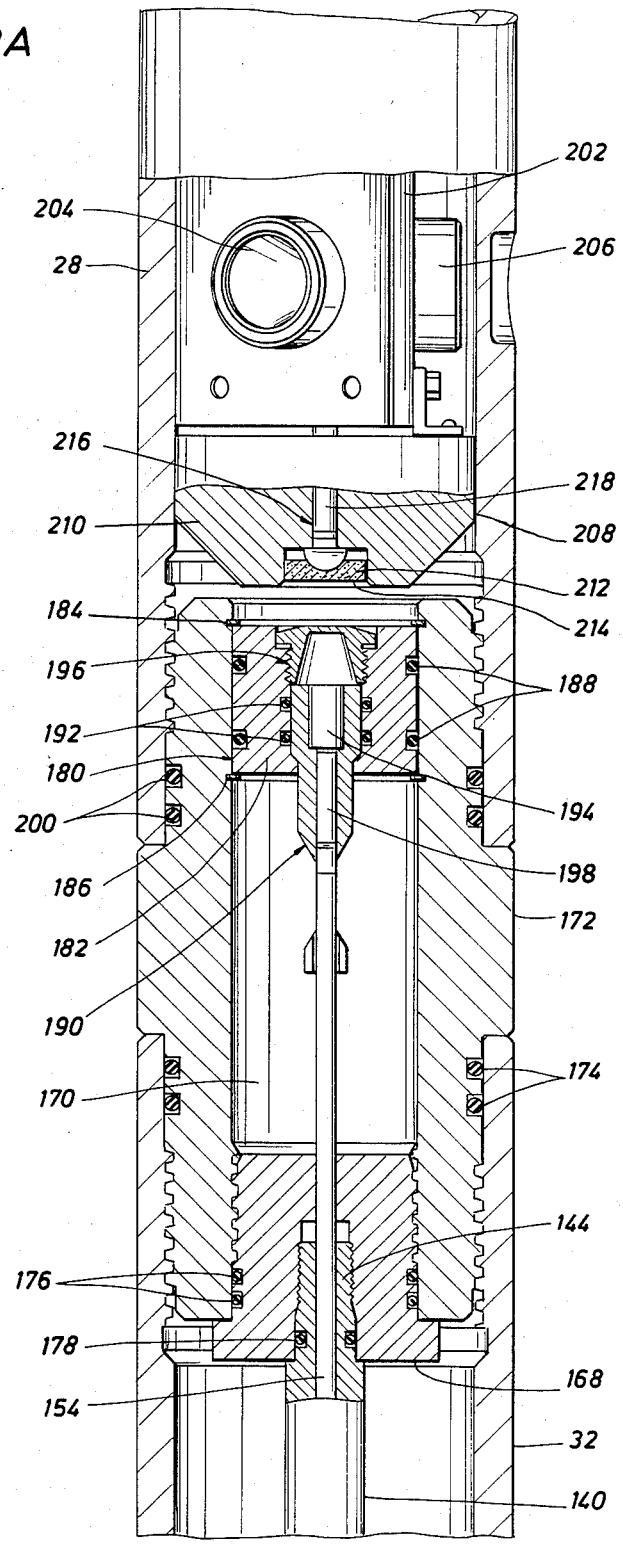
FIG. 2 is a longitudinal sectional view of the firing head assembly and a portion of the perforating gun of FIG. 1.

Referring now to the drawings in more detail, particularly to FIG. 1, there is illustrated a tubing conveyed perforating system in accordance with the present invention. A wellhead 10 has a tubing string 12 extending through the interior of a casing string 14. A suitable packer assembly 16, which can be of any number of commonly used forms, is attached to tubing string 12 and sealingly engages casing 14 dividing the casing annulus into a lower and an upper annulus 18 and 20, respectively. A fluid vent assembly 22, which typically is a perforated nipple or a tubing activated sub, is attached to tubing string 12 below packer assembly 16 and includes a plurality of ports 24 which in the open position fluidly communicate lower annulus 20 with the interior of tubing string 12. A firing head assembly 26 is attached to and underlies vent assembly 22. Mechanically coupled to firing head assembly 26 and disposed adjacent a potential hydrocarbon containing formation is perforating gun 28. Perforating gun 28 can be of any suitable type of the style commonly referred to as a "shaped charge" perforating gun.

Figure 2B:
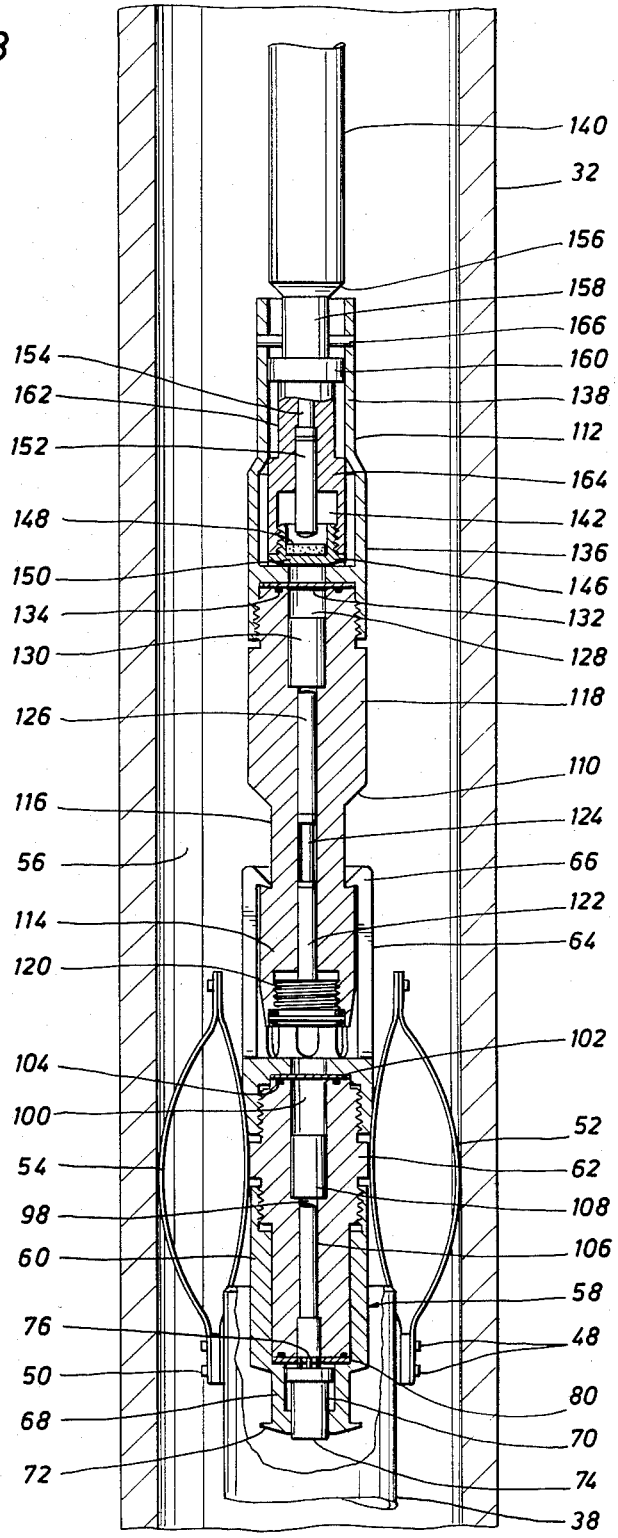
Figure 2C:
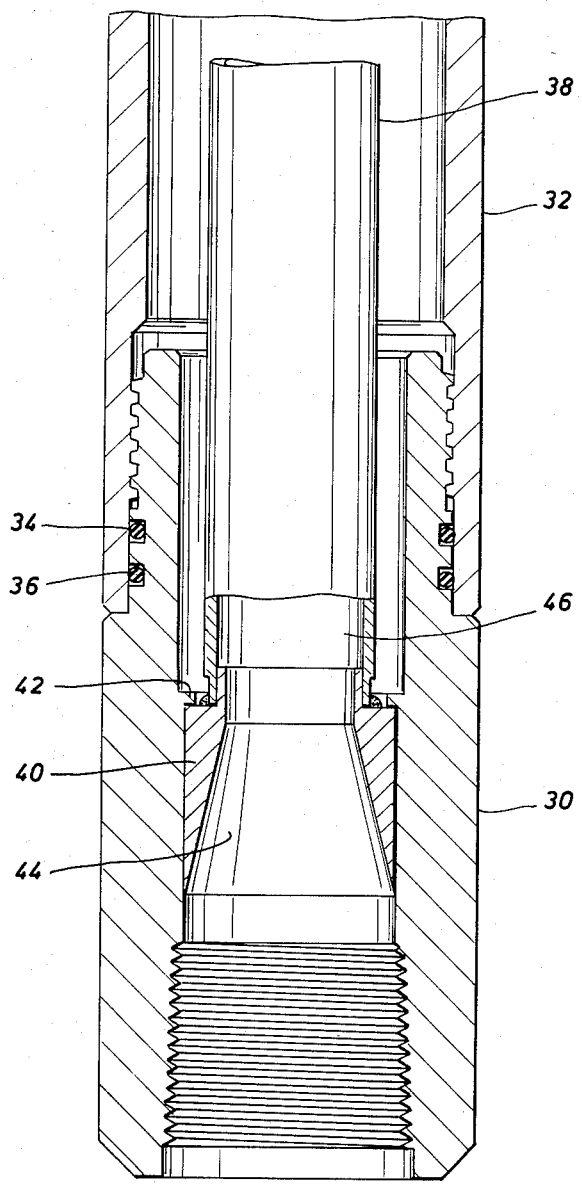

Referring now to FIG. 2 there is illustrated partly in longitudinal section firing head assembly 26 attached to the upper end of perforating gun 28. Connector sub 30 is a generally cylindrical member having a screw threaded proximal end for attachment to vent assembly 22 or tubing string 12. The second end section of connector sub 30 forms a reduced diameter externally threaded section. Tubular firing head assembly housing 32 has a screw threaded socket concentric therewith for receiving the reduced diameter threaded end of a connector sub 30. Seal members 34 and 36 provide a fluid occlusive seal isolating wellbore fluids from the interior of housing 32.

Mounted within connector sub 30 and extending into housing 32 is guide housing 38. Guide housing 38 is a generally cylindrical member having an enlarged outer diameter upper segment 40 engaging flange 42. The internal bore 44 of upper segment 40 is flared with the reduced diameter of the flare projecting into the internal passage 46 of the lower section of guide housing 38. Attached to guide housing 38, by suitable means such as screws 48 and 50, are centralizers 52 and 54, respectively. Centralizers 52 and 54 serve to keep guide housing 38 located substantially within the center of the internal bore 56 of firing head assembly housing 32.

Centralizers 52 and 54 additionally provide for the centering of the percussion firing assembly 58 within the internal passage 46 of guide housing 38 when such firing assembly 58 is installed within firing head assembly 26 in a manner to be more fully described later herein. Percussion firing assembly 58 includes firing pin housing 60 threadably coupled to firing sub 62 which is further coupled to grapple sub 64 terminating with dogs 66 having beveled ends. Firing pin housing 60 has a generally cylindrical section with a reduced decimeter upper section 68 having a generally cylindrical cavity 70 formed therein. Upper section 68 has outwardly projecting flange 72 which allows percussion firing assembly 58 to be detachably coupled to a delivery tool, such as a setting tool affixed to a gamma ray instrument. This allows percussion firing assembly 58 to be lowered from the surface and latched into firing head assembly 26 after firing head assembly 26 and perforating gun 28 are located within the well.

A better understanding of the firing system can be had by reference to FIGS. 2 and 3 where there is illustrated in detail the percussion firing system of percussion firing assembly 58. Identical reference numbers are used for identical elements in these figures. Firing pin 74 is retained within cavity 70 with one end extending outside firing pin housing 60. A plurality of percussion ignition pins 76 are attached to the other end of firing pin 74. In the preferred embodiment three elongated ignition pins having hemispherically tapered ends are utilized. Ignition pins 76 extend through passages within retainer ring 78. Frangible barrier 80 isolates ignition pins 76 from explosive primer cartridges 82 which are retained within the cavities 84 within cartridge retainer 86. Alignment of ignition pins 76 with primer cartridges 82 is provided by alignment pin 88 which inserts into bore 90 of retainer ring 78 and bore 92 of cartridge retainer 86. Additionally, seal member 94 fits within circular groove 96 in cartridge retainer 86.

Returning now to FIG. 2, sub 62 has a first elongated bore 98 located along the longitudinal axis with a centrally located cavity 100 approximately one-half inch in diameter located at the lower end thereof. The opening of cavity 100 is covered by frangible barrier 102 which along with seal member 104, are held in place by the inward flange portion of grapple sub 64 when grapple sub 64 threadably engages sub 62. In the preferred embodiment frangible barriers 80 and 102 are constructed of steel approximately 0.060 inches in thickness. Located within bore 98 is explosive booster charge 106 which may be, for example a DuPont P-43 booster. The booster charges are relatively insensitive and not readily detonated other than by a force of an explosive nature as provided by primer cartridges 82. Shaped charge 108 is installed within cavity 100 in juxtaposition with booster 106 and has an axis of perforation aligned substantially along the longitudinal axis of firing head assembly 26.

Attached to grapple sub 64 is a primary stem explosive assembly including primary stem housing 110 threadably connected to adapter sleeve 112. Primary stem housing 110 has a tapered upper segment 114 below which is located a reduced outer diameter section 116 which flares into a generally circular segment 118. Mounted within a central cavity in upper segment 114 is an explosively loaded screw port 120, such as that found in U.S. Patent Application Ser. No. 476,448 which is incorporated herein by reference. In juxtaposition with loaded screw port 120 is explosive booster charge 122 located in a central passage of primary stem housing 110. Booster 122 is preferably a model P-3 supplied by DuPont Corporation. Crimp-connected to booster 122 is detonator cord 124 which is further crimp-connected to explosive booster charge 126 which is preferably a Dupont Model P-43. Mounted within cavity 128 in juxtaposition with booster 126 is shaped charge 130. Cavity 128 is sealed by frangible barrier 132 and sealing member 134 which are held in place by the inward flange portion of adapter sleeve 112.

Adapter sleeve 112 includes a generally cylindrical first section 136 tapering approximate the midpoint to a reduced diameter generally second cylindrical section 138. Projecting within adapter sleeve 112 is the upper end portion of secondary stem explosive assembly. Secondary stem explosive assembly includes a elongated tubular member 140 having a first end with cavity 142 formed therein and a second threaded end 144. Installed within cavity 142 is a loaded screw port 146. Loaded screw port 146, as with screw port 120, includes a quantity of explosive material 148 retained within a threaded member 150 commonly referred to as a screw port. Extending into cavity 142 is explosive booster charge 152, which in the preferred embodiment is a DuPont Model P-3, which is crimp connected to a detonator cord 154 which traverses the longitudinal bore of tubular member 140. Detonator cord 154 is preferably, but not limited to, the type known commercially as R.D.X. plastic covered Primacord. The first end of elongated tubular member 140 includes a tapered outer section 156, a reduced outer diameter section 158 followed by an enlarged outer diameter ring 160, an intermediate outer diameter section 162 returning to an end portion 164 having an outer diameter equal to that of the main section of tubular member 140. The lower end of cylindrical section 138 of adapter sleeve 112 is secured to section 158 of tubular member 140 by a pair of shear pins 166.

firing head is pulled off by tension from the wireline and is removed from the well. Perforating gun 28 and firing head assembly 26 can then be removed by pulling tubing string 12. Since no primary explosives are present the danger of accidental ignition during the removal process are all but eliminated.

Many modifications and variations besides those specifically mentioned may be made in the techniques and structures described herein and depicted in the accompanying drawing without departing substantially from the concept of the present invention. Accordingly, it should be clearly understood that the form of the invention described and illustrated herein is exemplary only, and is not intended as a limitation on the scope of the present invention.

The embodiments of the invention in which an exclusive property or privilege is claimed are defined as follows:

1. A method for perforating subsurface earth formations surrounding a borehole, comprising the steps of:

positioning on the end of a tubing string a perforating gun and a firing head assembly within a borehole, said firing head assembly including first and second explosive detonator assemblies mechanically and explosively serially aligned, said first detonator assembly detachably mechanically coupled to said second detonator assembly;

subsequently lowering through said tubing string a percussion firing assembly into coupling relationship within said firing head assembly; and dropping an impact member through said tubing string, the collision of said impact member with said percussion firing assembly for detonating said percussion firing assembly to thereby detonate said firing head assembly and said perforating gun.

2. The method of claim 1 further including the steps of:

removing said percussion firing assembly and said second explosive detonator assembly portion of said firing head assembly from said borehole;

subsequently lowering an electrical firing assembly into coupling relationship within said firing head assembly; and passing an electrical control signal to said electrical firing assembly for detonating said firing head assembly to thereby detonate said perforating gun.

3. The method of claim 2 further including the steps of:

removing said electrical firing assembly from said borehole; and subsequently removing said perforating gun and said firing head assembly from said borehole, said perforating gun and said firing head assembly including no initiating explosives therein.

4. Apparatus for perforating subsurface earth formations surrounding a borehole, comprising:

an elongated perforating gun having a plurality of radially directed shaped charges mounted therein;

a first explosive detonator assembly mechanically coupled to said perforating gun;

a second explosive detonator assembly mechanically coupled to said first detonator assembly, said second explosive detonator assembly being selectively detachable from said first explosive detonator assembly and aligned for transferring a detonating wave from said second detonator assembly to said first detonator asssembly; and a percussion firing assembly adapted for latching engagement with said second detonator assembly.

5. The apparatus of claim 4 wherein said first detonator assembly comprises:

an elongated member having a central bore therethrough;

an explosively loaded screw port mounted within one end of said elongated member;

an explosive booster juxtaposed with said loaded screw port;

a length of detonator cord having a first end coupled to said explosive booster, said detonator cord traversing said central bore in said elongated member; and a detonating wave propagation means coupled to the second end of said detonator cord for explosively coupling a detonation wave to said perforating gun.

6. The apparatus of claim 5 wherein said propagation assembly comprises:

a shaped charge having the axis of perforation aligned generally along the longitudinal axis of said first detonator assembly and an explosive booster connected to the second end of said detonator cord.

7. The apparatus of claim 4 wherein said second detonator assembly comprises:

a housing member having a reduced diameter shoulder proximate a first end thereof;

an explosively loaded screw port mounted within said first end of said housing member;

a first explosive booster juxtaposed with said screw port;

a length of detonator cord having a first end coupled to said first booster;

a second explosive booster coupled to the second end said detonator cord; and a shaped charge juxtaposed with said second booster having the axis of perforation generally along the longitudinal axis of said housing.

8. The apparatus of claim 4 wherein said percussion firing assembly comprises:

a housing having an outwardly flared first end portion, and a second end grapple portion, said grapple portion having a plurality of elongated grapple arms terminating with inwardly directed dogs;

a percussion firing pin a portion thereof extending from said first end portion;

an impact sensitive explosive primer located proximate said percussion firing pin;

a shaped charge having the axis of perforation generally along the longitudinal axis of said housing; and means for carrying a detonating wave from said explosive primer to said shaped charge.

9. The apparatus of claim 8 wherein said percussion firing pin further comprises a plurality of hemispherically tapered percussion ignition pins extending from said firing pin.

10. The apparatus of claim 9 wherein said impact sensitive explosive primer further includes a plurality of explosive primer cartridges disposed beneath said plurality of ignition pins.

11. A perforating apparatus for perforating subsurface earth formations surrounding a borehole including a perforating gun adapted to be conveyed into a borehole on the end of a length of tubing string and having a firing assembly interposed therebetween said firing assembly comprising:

Threadably attached to second end 144 of tubular member 140 is bushing member 168 having a central bore therethrough traversed by detonator cord 154. Bushing member 168 is mounted within a central bore 170 of coupling sub 172 which is threadably coupled to firing head assembly housing 32. Occlusive seals are provided by seal members 174 between coupling sub 172 and firing head assembly housing 32, by seal members 176 between coupling sub 172 and bushing member 168 and by seal member 178 between coupling sub 172 and tubular member 140.

Mounted within coupling sub 172 is donor assembly 180 of the perforating gun detonating system. Donor assembly 180 includes an outer housing or bushing 182 sized for insertion within bore 170 of coupling sub 172 and has a central bore therethrough. A pair of retainer rings 184 and 186 constrain outer housing 182 within coupling sub 172 and a pair of seal members 188 provides an occlusive fluid seal therebetween. Retained within the central bore of bushing 182 and extending rearwardly therefrom is internal member 190 having a pair of seal members 192 thereabout. Mounted within an internal bore of internal member 190 is shaped charge 194. Shaped charge 194 may be of various designs known in the art, in the preferred embodiment is approximately one inch in length and one-half inch in outer diameter and having the type of explosive commonly referred to as cyclonite. Shaped charges 194, 130 and 108 are of a common design. Screw port 196 is threadably installed within bushing 182 substantially in line with the axis of perforation of the "jet" produced by shaped charge 194. Retained within the rearward portion of internal member 190 and placed in juxtaposition with shaped charge 194 is booster charge 198 which is connected to detonator cord 154 and is preferably a model P-3 booster available from DuPont Corporation.

Coupling sub 172 is threadably coupled to perforating gun 28. The threaded joint is provided with a fluid-tight seal by seal members 200. Perforating gun 28 includes a carrier member 202 retained therein. Mounted along the length of carrier member 202 are a plurality of shaped charges, illustrated at 204 and 206 having their axis of perforation directed generally in the surrounding formations. Mounted within the central bore of perforating gun 28 is acceptor assembly 208 of the detonation system. Acceptor assembly 208 includes a housing or holder member 210 having a cavity formed generally centrally therein. Mounted within the cavity is a generally cup shaped pellet 212 of explosive material. Explosive pellet 212 can be from approximately 2–6 grams of cyclonite or other suitable explosive material. The cavity is covered with a frangible barrier 214, such as a relatively thin piece of aluminum. Explosive booster charge 216 is connected by suitable means, such as a crimped-connection, to detonator cord 218. Detonator cord 218 extends the length of the perforating gun 28 and provides the detonation of any shaped charges mounted therein. The second end of detonator cord 218 may be terminated at a door assembly identical with the one described herein thereby allowing for the serial explosive coupling of additional perforating gun assemblies.

In the operation of the perforating system described in the Figures, perforating gun 28 and firing head assembly 26 are attached to tubing string 12 and portioned within the casing string 14 at a location below packer assembly 16. In accordance with the present invention no primary explosives are present in the perforating gun/firing head assembly during this operation. Firing sub 58 is lowered through tubing string 12 by means of a setting tool attached to a wireline (not shown). The setting tool couples over flange 72 of sub 60. By means of the wireline, the setting tool and firing sub are lowered through internal bore 44 of guide housing 38 until dogs 66 of grapple sub 64 engage the shoulder formed by the upper terminus of reduced diameter section 116 of primary stem housing 110. Once sub 60 is latched in place the setting tool and the wire line are removed from tubing string 12. To instigate ignition of perforating gun 28 an impact bar, commonly referred to as a "go devil" is dropped from the surface through tubing string 12. The impact bar passes through internal bores 44 and 46 of guide housing 38 hitting firing pin 74 driving ignition pins 76 through frangible barrier 80 onto primer cartridges 82. The explosion of primer cartridges 82 detonates booster charge 106 further detonating shaped charge 108.

Upon ignition, shaped charge 108 forms a "jet" which penetrates frangible barrier 102 and screw port 120 detonating the explosives material within screw port 120 thereby detonating booster charge 122. The detonation of booster charge 122 is coupled through detonator cord 124 to detonate booster charge 126 which in turn detonates shaped charge 130. The detonation of shaped charge 130 causes a jet to form penetrating frangible barrier 132 and screw port 150 igniting explosive material 148 thereby igniting explosive booster charge 152. The detonation of booster charge 152 causes detonation wave to travel through detonator cord 154 to booster charge 154 to booster charge 192. Booster charge 198 transfers the detonation wave into shaped charge 194 causing a jet to be formed. The jet inturn detonates explosive pellet 212 thereby causing ignition of explosive booster charge 216. The detonation of booster charge 216 is transferred onto detonator cord 218 further detonating shaped charges 204, 206 and the other shaped charges in perforating gun 28, or subsequent perforating guns attached thereto.

In the event ignition of the perforating gun shaped charges is not caused by the impact bar, the present system provides a back-up electrical ignition method. An overshot grapple is lowered into the tubing string by means of a slick line or wireline. The grapple is lowered into guide housing 38 until the grapple engages flang 72 of percussion firing assembly 58. Upward tension is exerted causing shear pins 166 to break allowing percussion firing assembly 58 and primary stem housing 110 to be removed from firing head assembly housing 32. With percussion firing assembly 58 and primary stem housing 110 removed an electrical firing head can be attached to a wireline and lowered through tubing string 12 into firing head assembly 26. The electrical firing head is equipped with a grapple sub identical to grapple sub 64. The electrical firing head is lowered into firing head assembly 32 until the dogs, which are identical to dogs 66 of grapple sub 64, clamp over end portion 164 onto the shoulder of elongated tubular member 140 of the secondary stem explosive assembly. An electrical signal can then be transmitted from the surface to a detonator located in the electrical firing head, thereby igniting a shaped charge which forms a jet further igniting explosive material 148 and booster charge 152 which detonates the system in the manner hereinbefore described. Should the electrical firing head fail to detonate the perforating gun the electrical an elongated tubular housing coupled between said perforating gun and said tubing string;

a first explosive detonator assembly coupled to said perforating gun for transferring a detonating wave into said gun;

a second explosive detonator assembly detachably coupled to said first detonator assembly for transferring a detonating wave into said first detonator assembly; and an attachable impact sensitive firing assembly adapted to be lowered through said tubing string into latching engagement with said second explosive detonator assembly.

12. The apparatus of claim 11 further comprising:

a guide member coaxially located within said tubular housing proximate said tubing strings; and centralizer means for centering said impact sensitive firing assembly within said guide means.

13. The apparatus of claim 12 wherein said first explosive detonator assembly further comprises:

an elongated tubular member located generally on the longitudinal axis of said housing;

an explosively loaded screw port mounted in one end of said tubular member;

a shaped charge mounted at the second end of said tubular member having the axis off perforation in line with said perforating gun; and means for carrying a detonation wave from said screw port to said shaped charge.

14. The apparatus of claim 13 further comprising explosive means located in said perforating gun substantially in line with said shaped charge located in said first explosive detonator assembly for transferring a detonating wave into said perforating gun.

15. The apparatus of claim 14 wherein said second detonator assembly further comprises:

an elongated housing having a reduced diameter shoulder proximate one end thereof;

an explosively loaded screw mounted in said one end of said housing;

a shaped charge mounted in the second end of said housing having the axis of perforation in line with said screw port within said first detonator assembly; and shear members for detachably coupling the second end of said housing to said first detonator assembly.

16. The apparatus of claim 15 further comprising shear members coupling said second end of said housing of said second detonator assembly with said first detonator assembly.

17. The apparatus of claim 16 wherein said impact sensitive firing assembly further comprises:

a housing member having an outwardly flared first end position and a second grapple end portion for latching engagement with said second detonator assembly;

a percussion firing pin extending from said first end portion;

impact sensitive explosive primer located in line with said firing pin;

a shaped charge located in said housing member having an axis of perforation generally in line with said screw port within said second detonator assembly; and means for carrying a detonating wave from said explosive primer to said shaped charge.

18. The apparatus of claim 17 wherein said firing pin further comprises three hemispherically tapered ignition pins extending from said firing pin.

19. The apparatus of claim 18 wherein said explosive primer further comprises three explosive pellets located beneath said three ignition pins.

20. The apparatus of claim 19 further comprising a frangible member interposed between said explosive pellets and said ignition pins.

* * * * *